US008940174B2

(12) United States Patent
Berndt et al.

(10) Patent No.: US 8,940,174 B2
(45) Date of Patent: Jan. 27, 2015

(54) METHOD FOR TREATING SPENT ABRASIVE SLURRY

(75) Inventors: Rolf Berndt, Dietzenbach (DE); Jochen Ruth, Buedingen (DE)

(73) Assignee: Pall Corporation, Port Washington, NY (US)

( * ) Notice: Subject to any disclaimer, the term of this patent is extended or adjusted under 35 U.S.C. 154(b) by 941 days.

(21) Appl. No.: 12/299,017

(22) PCT Filed: Oct. 30, 2007

(86) PCT No.: PCT/EP2007/009405

§ 371 (c)(1), (2), (4) Date: Nov. 13, 2008

(87) PCT Pub. No.: WO2009/056152

PCT Pub. Date: May 7, 2009

(65) Prior Publication Data

US 2010/0170161 A1 Jul. 8, 2010

(51) Int. Cl.

*B01D 37/00* (2006.01)
*C09K 3/14* (2006.01)
*B01D 36/04* (2006.01)
(Continued)

(52) U.S. Cl.

CPC ..... *C10M 175/0058* (2013.01); *B24B 57/00* (2013.01); *C10M 2201/061* (2013.01); *C10M 2209/104* (2013.01); *C10N 2270/00* (2013.01)
USPC ..... 210/651; 210/804; 210/774; 210/259; 210/195.1; 210/182

(58) Field of Classification Search

CPC .... B01D 61/145; B01D 61/147; B01D 61/16; B01D 61/025; B01D 21/0012; B01D 29/23; B01D 33/00; B01D 33/0087; B01D 35/30; B01D 37/00; B01D 35/18; B01D 17/00; B01D 21/02; B01D 17/0211; B01D 21/009; C02F 1/444; C02F 1/02; C02F 3/28; C02F 1/283; C02F 1/441; C02F 3/1242; C02F 1/78; C02F 9/00; C02F 1/24; C10G 33/06; A61M 1/3679; A01K 59/06
USPC ..... 51/306, 307; 210/804, 774, 259, 195.1, 210/182

See application file for complete search history.

(56) References Cited

U.S. PATENT DOCUMENTS

| | | | | |
|---|---|---|---|---|
| 5,772,900 | A | 6/1998 | Yorita et al. | |
| 6,001,265 | A * | 12/1999 | Toyama et al. | 210/712 |
| 6,231,628 | B1 | 5/2001 | Zavattari et al. | |
| 2004/0069878 | A1 * | 4/2004 | Osuda et al. | 241/23 |
| 2004/0251010 | A1 * | 12/2004 | Doh et al. | 165/172 |
| 2008/0250723 | A1 * | 10/2008 | Fragiacomo | 51/298 |

FOREIGN PATENT DOCUMENTS

| | | |
|---|---|---|
| DE | 44 05 829 | 8/1995 |
| DE | 100 11 513 | 9/2001 |

(Continued)

*Primary Examiner* — Krishnan S Menon
*Assistant Examiner* — Dwan A Gerido
(74) *Attorney, Agent, or Firm* — Leydig, Voit & Mayer

(57) ABSTRACT

A method for treating spent abrasive slurry obtained from cutting a body of a substrate material into wafer-like slices, the slurry comprising a lubricant fluid, unspent abrasive particles and fines, is disclosed, method comprising separating the spent slurry in a first sedimentation step into a solids concentrate comprising unspent abrasive particles and a solids depleted slurry; and subsequently separating the solids depleted slurry by cross-flow filtration into a fines containing fraction and a solids and fines depleted regenerated lubricant fluid.

11 Claims, 4 Drawing Sheets

(51) Int. Cl.

| | |
|---|---|
| ***B01D 21/00*** | (2006.01) |
| ***C10M 175/00*** | (2006.01) |
| ***B24B 57/00*** | (2006.01) |

(56) References Cited

FOREIGN PATENT DOCUMENTS

| | | | |
|---|---|---|---|
| EP | 0 791 385 | | 8/1997 |
| EP | 1 561 557 | | 8/2005 |
| JP | 4-315576 | | 11/1992 |
| JP | 10-216554 | A2 | 8/1998 |
| JP | 11-033913 | A2 | 2/1999 |
| JP | 2000-117636 | A2 | 4/2000 |
| JP | 2002-083789 | A2 | 3/2002 |
| JP | 2003-340719 | A2 | 12/2003 |
| KR | 2003-005575 | | 1/2003 |
| WO | WO 01/66678 | | 9/2001 |
| WO | WO 02/096611 | | 12/2002 |
| WO | WO 2006/137098 | | 12/2006 |

* cited by examiner

METHOD FOR TREATING SPENT ABRASIVE SLURRY

BACKGROUND OF THE INVENTION

The present invention relates to a method for treating spent abrasive slurry obtained from a process for cutting a body of a substrate material into wafer-like slices. Typically, abrasive slurries are applied in the cutting of semiconductor materials, e.g., ingots from single crystals or polycrystalline silicon, GAs and Ge by means of wire saws into semiconductor wafers and comprise a lubricant or cooling fluid of high viscosity such as a mineral oil or water-soluble liquids (e.g., polyethylene glycol) and a particulate matter from abrasives such as silicon carbide.

While the wires used for cutting the ingots into slices have a smooth surface, the cutting effect is obtained by use of the highly viscose abrasive slurry which is fed to the contact area of the cutting wire and the substrate material to be cut into slices.

During the cutting operation, the substrate material is ground at a so-called saw kerf into powdery material. The slurries also serve to remove such powder substrate material from the saw kerf.

During the cutting operation, the abrasive slurries are contaminated in three ways: The substrate material (e.g. silicon or other semiconductor material) is disintegrated into particles that are taken up by the slurry. The metal of the cutting wires (primarily iron) is another source for particulate contaminations due to surface wear of the wire. Finally, the grains of the abrasive material itself are partially disintegrated into smaller particles which are, of course, also incorporated in the abrasive slurry.

As the concentrations of these three contaminants (in the following called fines) increase over time, the efficiency of the cutting operation decreases. When the slurry finally becomes ineffective, i.e., spent or exhausted, it must be discarded.

The spent slurry is either been disposed of (by incineration or other means) or regenerated.

The methods for regenerating spent abrasive slurries which were heretofore proposed rely on two different principles. The first one starts with the separation of the exhausted slurry into a first liquid fraction and a first solids fraction. Afterwards, the two fractions are regenerated separately, involving various operations such as diluting, washing, classification, filtration, etching, evaporation and others. The regenerated liquid and the regenerated solids fraction, the latter having no or a reduced content of fines, can be used for the preparation of fresh slurry. Examples of such processes are disclosed in WO 2002/096611 and in EP 1 561 557 A1.

There are numerous disadvantages to this method, and the most prominent one is its complexity. The large number of operations needed and in addition the high degree of interactions between these operations would make a small system which can be located and operated near the point of use to regenerate the spent slurry from a local user rather expensive. Therefore, this technology has been used in large centralized units which make it necessary that the spent slurry is transported from the facilities of the users to the regeneration site. The transport costs involved in the regeneration of the abrasive slurry are therefore substantial.

A certain improvement might be possible by lowering the viscosity of the spent slurry by heating the same as is proposed in U.S. Pat. No. 6,231,628 B1. However, the heating of rather highly concentrated slurry creates the risk of scaling, encrustation, fowling and abrasion of heat transfer surfaces resulting in lower heat transfer efficiency, limited life time of the heater and increased energy costs.

The other principle used for slurry regeneration is based on the use of a combination of two centrifuges. In the first centrifuge, a classification of particles is achieved, i.e., the slurry is divided into two fractions that contain both a part of the lubricant and a part of the solids. The two fractions differ in their solids concentration and in particle size distribution of the solids. The overflow of the first centrifuge mainly contains the majority of the lubricant and the smaller particles (fines or debris from semiconductor material, wire and abrasive material, typically below about 10 μm). The sludge resulting from the first centrifugation step (flowable concentrate) contains preferably the abrasive grains with sizes near to those of new slurry (essentially above about 10 μm). The volume of the sludge containing the re-usable abrasive grains is much smaller than the volume of the overflow. The classification effect results from the differences in settling velocities of the particles in the centrifugal field.

Larger particles sink faster, and they are favored to leave the centrifuge with the sludge. Smaller particles that settle with lower speed are easier carried and swept along with the liquid overflow of the centrifuge. The overflow is clarified by means of a second centrifuge resulting in a sludge to be discarded (small waste particles or fines in a small amount of lubricant fluid) and a more or less clarified stream of lubricant. Although this principle necessitates less operations than the first one described above and although it might be easier installed as a point-of-use process, two major disadvantages prevent the method from being widely used.

First of all, the second centrifuge is not capable of clarifying the overflow fraction of the first centrifuge satisfactorily to provide a readily re-usable lubricant. A substantial part of the fines remains in the lubricant and pollutes, when applied to prepare fresh slurry, this slurry from the beginning.

Secondly, the classification effect in the first centrifuge is far from being ideal: Substantial amounts of fines leave the centrifuge with the unspent abrasive particles contaminating fresh slurries prepared with the recovered abrasives in addition and limit the life time of the fresh slurries.

The reasons for this are some limitations of the centrifugal process:

i) High solids concentration of a common saw sludge favor particle-particle interactions; large particles can entrain fines along with them, forcing them to leave the centrifuge the wrong way out. The effect is strong especially near the inner wall of the centrifuge bowl where most of the solids are concentrated.

ii) The high viscosity of the lubricant amplifies the momentum transfer between the particles; small particles are much influenced by coarse ones.

The object of the present invention is to provide a method for treating spent abrasive slurries in a more economical way. Especially, the present invention provides a method for treating the spent abrasive slurry which may be carried out at the point of use obviating long transportation of the spent slurry for regeneration.

SUMMARY OF THE INVENTION

The present invention provides a solution to this object by the method defined in claim 1.

The first sedimentation steps may be accomplished by simple gravity sedimentation. Advantageously, the preferred embodiments of the present invention make use of a centrifugal field in this step which allows for more compact equipment.

The present invention uses a cross-flow filtration device (e.g., ultrafiltration or cross-flow microfiltration) which allows removing practically all fines from the lubricant. The cross-flow filtration device may be incorporated in the treatment system downstream of the second centrifuge mentioned for the second method above or it can fully replace such a second centrifuge. The regenerated lubricant fluid, i.e., the filtrate or permeate equals an unused lubricant as far as its content of fines, i.e., particulates and colloidal components are concerned.

Its use for preparing a fresh slurry greatly reduces fines contaminations and increases slurry life time even if combined with a solids concentrate obtained in a conventional way by the centrifugation of spent slurries, which is due to the excellent quality of this liquid.

In a preferred embodiment the filtrate is split and one portion thereof is mixed with the spent slurry in the feed of the first sedimentation step. This lubricant recycling dilutes the spent slurry increasing the distance between the particles and, as a consequence, lowers the particle-particle interactions and improves classification efficiency of the first sedimentation step. Thereby, the amount of fines polluting the coarse abrasive particles obtained in the sludge of the first sedimentation step is diminished. The combination of the regenerated lubricant fluid and the solids concentrate obtained according to this embodiment provides fresh slurry of excellent quality and further increased slurry life time.

Preferably, the regenerated lubricant fluid and said spent slurry are admixed in a volume ratio of from about 0.5:1 to about 3:1, more preferably of from about 1:1 to about 3:1.

Mixing of the lubricant and the spent slurry may be preferably accomplished in a static mixer.

This allows low-cost equipment, and the efficiency provided by a static mixer is sufficient for the purpose.

In an even more preferred embodiment, the one portion of the regenerated lubricant fluid used to dilute the spent slurry is heated to an elevated temperature prior to admixing the same with the spent slurry. The resulting mixture of spent slurry and regenerated lubricant fluid is at an elevated temperature, preferably at about 35° C. or more, more preferably at a temperature of 50° C. or more. The elevated temperature lowers the viscosity of the slurry/lubricant mixture. The lower viscosity accelerates the sedimentation of the particles within the fluid and such overcompensates the increased feed rate into the centrifuge and to the cross-flow separation device. It furthermore improves the classification efficiency and thus provides a higher quality first solids concentrate.

Heating the regenerated lubricant fluid prior to admixing the same with the slurry is of advantage over a direct heating of the spent slurry itself. Heating the regenerated lubricant fluid obtained in the present invention prior to admixing the same with spent slurry avoids the risk of scaling, encrustation, fouling and abrasion of heat transfer surfaces, since the liquid passing the heater practically no particles and almost no colloidal components.

The lubricant fluid obtained in the cross-flow filtration step which is re-used to produce fresh slurry may be cooled down in a cooling device prior to admixing the same with the solids concentrate obtained from the first sedimentation step and optional supplemental fresh slurry.

The present invention also resides in a system for treating spent abrasive slurries according to a method as described above.

Preferred embodiments of such systems are evident from the above discussion of the inventive process where the various devices advantageously used in such an inventive system have already been discussed.

The present invention is explained by way of the following examples and embodiments in more detail.

DETAILED DESCRIPTION OF THE INVENTION

Figure 1:
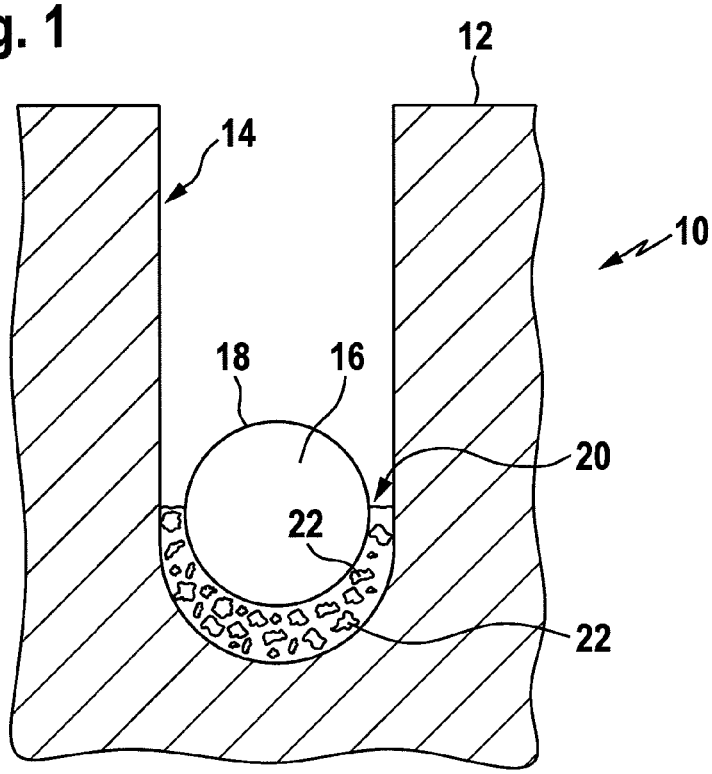
FIG. 1 shows a schematic representation of a cutting wire in a saw kerf.
Figure 2:
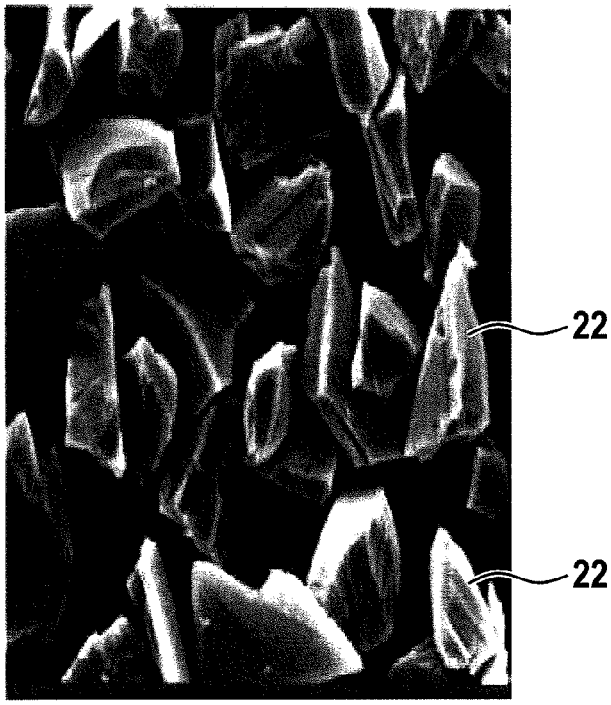
FIG. 2 shows a schematic enlarged representation of abrasive particles.

FIG. 1 shows a cut-out of a cross-sectional representation of an ingot body 10 of, e.g., silicon which has been cut already to a certain depth starting from an outer circumference 12 to produce a kerf 14. Within kerf 14, a cutting wire 16 is positioned which has an approximately circular cross-section and a smooth outer surface 18. In the portion of kerf 14 where the cutting wire 16 contacts the ingot body 10, an abrasive slurry 20 is present to cool and lubricate the cutting tool and the substrate material of the ingot while at the same time supporting abrasion of the substrate material of ingot 10. To that effect, the abrasive slurry 20 includes besides a viscous lubricant fluid abrasive particles or grains 22 which are shown in FIG. 2 in more detail. The average size of the abrasive grains 22 shown in FIG. 2 is about 20 μm and these abrasive grains 22 work on the substrate material of ingot 10 driven in a longitudinal motion of cutting wire 16, a motion which would be perpendicular to the surface of the drawing. The lubricating liquid which forms part of the abrasive slurry is a highly viscous fluid, for example a mineral oil or a water-soluble organic liquid like polyethylene glycol.

The high viscosity is needed in order to provide for sufficient abrading action of the abrasive grains 22 in kerf 14. The high viscosity is further needed in order to provide for sufficient lubrication.

In addition to the above functions of the abrasive slurry 20, the slurry also provides for removal of the deteriorated substrate material (fines) produced during the cutting operation.

Therefore, the slurry 20 which is recycled in the cutting device until it is exhausted comprises besides the lubricating fluid, the abrasive grains 22 and the powdered substrate material which usually has an average particle size very well below about 10 μm, deteriorated material from the abrasive grains as well as metal particles created from wear of the cutting wire (herein in summary called fines).

The present invention provides for a cost-effective method and economical means for treating the spent slurry to an extent that at least large parts of it may be re-used for the cutting operation.

Figure 3A:
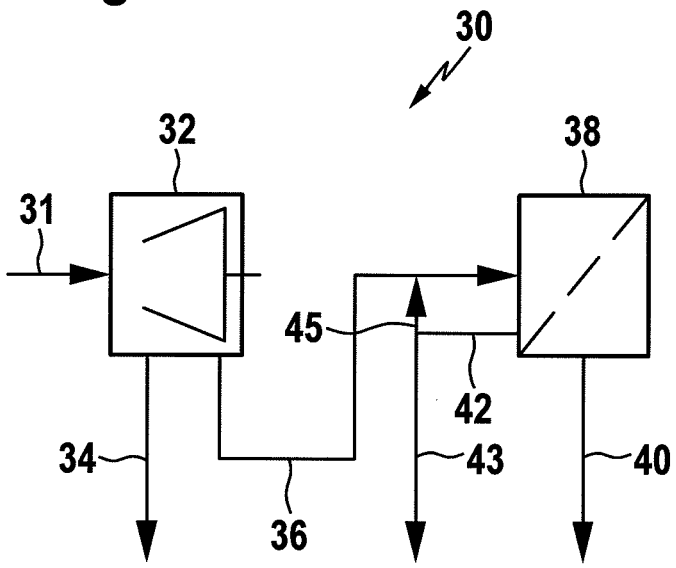
FIGS. 3*a* and *b* show two basic systems for implementing the inventive method.

The present invention in its simplest, but nevertheless already very efficient configuration is shown in FIG. 3*a*. The device according to FIG. 3*a* comprises a first sedimentation unit 32 which comprises a centrifuge and which receives the spent or exhausted slurry directly from the cutting process described above. The centrifuge of the first sedimentation unit 32 separates the spent abrasive slurry into a solids concentrate and a solids depleted slurry.

The solids concentrate is drained from the sedimentation unit 32 via line 34 and contains a smaller amount of the lubricant fluid of the abrasive slurry. The composition of the solids concentrate drained via line 34 is such that it may be directly used for the preparation of fresh abrasive slurry by combining same with regenerated lubricant fluid.

The overflow generated in the sedimentation unit 32 is a solids depleted slurry which is withdrawn from the sedimentation unit 32 via line 36 and fed into a cross-flow filtration unit 38. In the cross-flow filtration unit 38, which preferably is a membrane separation device, essentially all of the fines including colloidal dispersed particulate matter in the lubricating fluid may be removed such that the permeate which may be withdrawn from the cross-flow filtration unit 38 via line 40 is ready for re-use and preparation of a new or fresh abrasive slurry. This solids and fines depleted permeate is called herein regenerated lubricant fluid. The fines-containing fraction withdrawn from the cross-flow filtration unit 38 is removed by line 42 and comprises essentially all of the fines previously contained in the spent abrasive slurry. This fraction may be discarded in a conventional manner via line 43. In order to increase the efficiency of the cross-flow filtration unit, i.e., to increase the proportion of regenerated lubricant fluid which may be withdrawn via line 40, part of the fines-containing fraction may be recycled via line 45 and mixed with the solids depleted slurry which is fed via line 36 into the inlet of the cross-flow filtration unit 38.

Figure 3B:
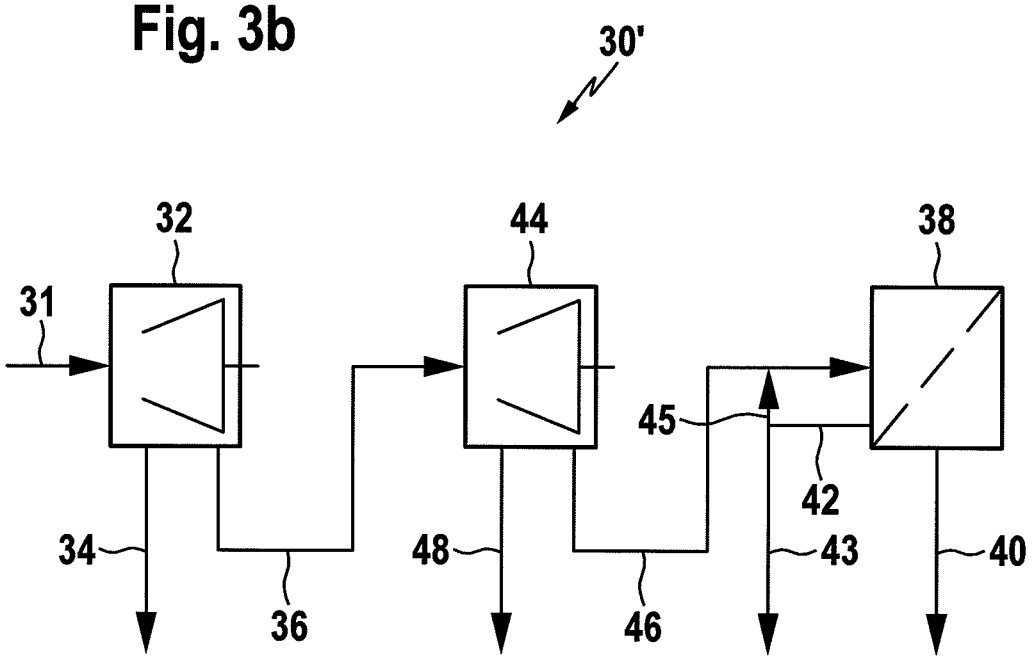

FIG. 3*b* shows a preferred variant of the device of FIG. 3*a* comprising in addition to the first sedimentation unit 32 a second sedimentation unit 44. The second sedimentation unit 44 comprises preferably a centrifuge and receives as its feed the solids depleted slurry from the first sedimentation unit 32 via line 36. The second sedimentation unit 44 serves to remove part of the fines included in the solids depleted slurry prior to transfer the same to the cross-flow filtration unit 38. In this embodiment, a solids and partly fines depleted slurry is fed via line 46 into the cross-flow filtration unit 38. A fines concentrate withdrawn from the second sedimentation unit 44 via line 48 mainly contains fines and is conventionally discarded.

The particle size in the fines concentrate is much lower than that of the particles contained in the first solids concentrate and also may comprise a substantial portion of abrasive grain debris, powdered substrate material and abraded metal particles from the cutting wire of the cutting system.

As described in connection with FIG. 3*a* already, the retentate (fines containing fraction) from the cross-flow filtration unit 38 may be partly recycled via line 45 to the solids and partly fines depleted slurry to improve the separation efficiency of the cross-flow separation unit 38 while the remainder is discarded via line 43.

Figure 4:
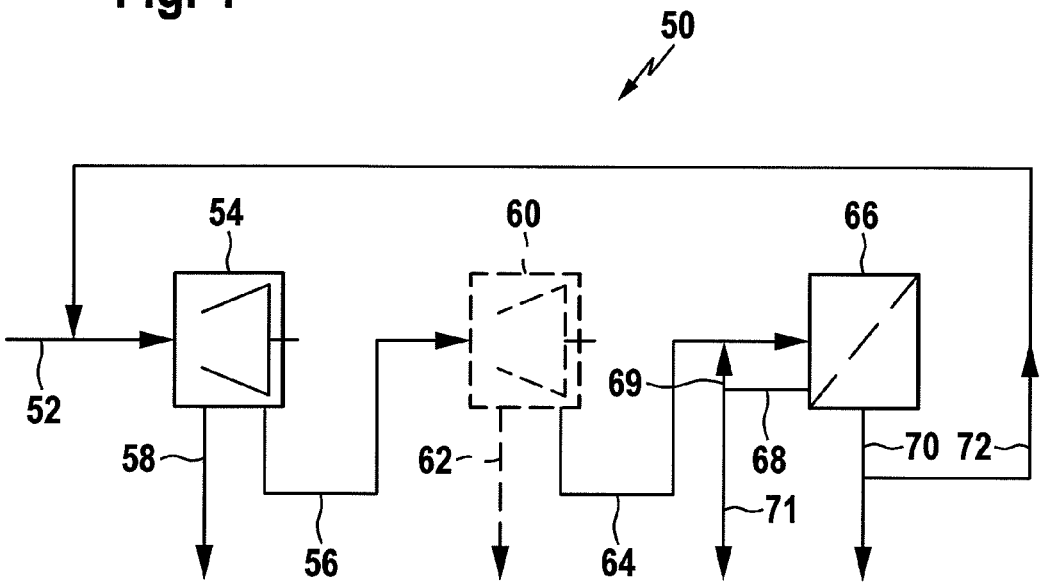
FIG. 4 shows a preferred embodiment of a system according to the inventive system.

FIG. 4 shows a preferred embodiment of a system 50 of the present invention for treating spent abrasive slurries, said system 50 receiving spent abrasive slurries via line 52. The spent abrasive slurry is fed into a centrifuge or first sedimentation unit 54 which provides an overflow in the form of a solids depleted slurry which is drained from centrifuge 54 via line 56. The sludge separated in centrifuge 54 from the spent slurry as a solids concentrate comprises the main portion of abrasive particles which still may be used in the cutting process. The sludge is withdrawn from centrifuge 54 via line 58.

The solids depleted slurry still including fines may be fed via line 56 into a second sedimentation unit in the form of centrifuge 60 to withdraw a fines concentrate as sludge via line 62. This fines concentrate comprises a substantial portion of fines. The solids and partly fines depleted slurry is withdrawn from centrifuge 60 as overflow via line 64 and sent to a cross-filtration unit 66.

In a variant of system 50, the second centrifuge 60 may be omitted and line 56 may be directly connected to line 64 so that the solids depleted slurry created in centrifuge 54 is directly fed into the cross-flow separation unit 66.

In the cross-flow separation unit 66, a retentate is withdrawn via line 68 as a fines containing fraction whereas the permeate is withdrawn via line 70 in the form of a (solids and fines depleted) regenerated lubricant fluid. One part of the retentate may be recycled via line 69 and the remainder discarded via line 71.

The quality of the so obtained regenerated lubricant fluid is such that it may be used without any further treatment for preparing fresh slurry, e.g., by combining the solids concentrate received from centrifuge 54 via line 58 and the regenerated lubricant fluid withdrawn from the cross-flow filtration unit 66 via line 70.

It has, however, turned out to be more efficient not to recycle all of the regenerated lubricant fluid to the process for preparing fresh abrasive slurry, but to recycle one part of it via a line 72 and combine it with the spent slurry received via line 52 from the cutting process. Surprisingly, recycling of part of the regenerated lubricant fluid and combining the same with the spent abrasive slurry received from the cutting process enhances the separation efficiency of centrifuge 54 and provides for a better quality of the solids concentrate withdrawn from centrifuge 54 via line 58.

The proportion of regenerated lubricant fluid combined with the spent slurry is preferably such that a ratio of from about 0.5:1 to about 3:1 results. More preferably, the ratio of regenerated lubricant fluid and spent abrasive slurry is in the range of from about 1:1 to about 3:1.

The proportion of the solids depleted regenerated lubricant fluid received in line 70 from the cross-flow separation unit 66 will be recycled to be combined with spent slurry independent of whether a second sedimentation unit is provided in the system 50 or not.

Figure 5:
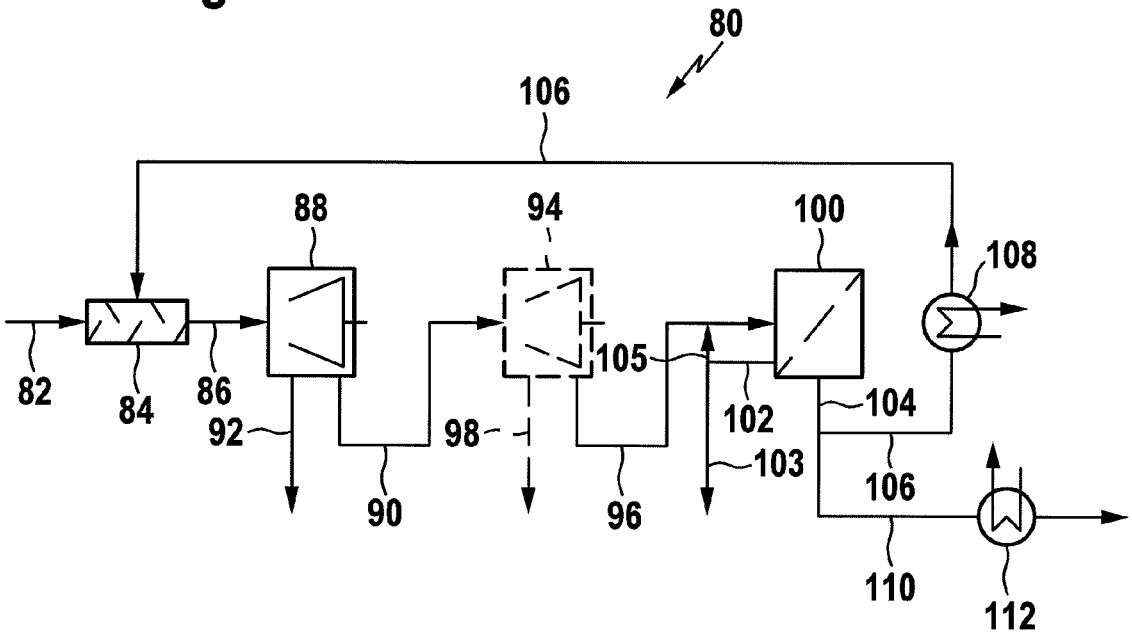
FIG. 5 shows an even further preferred embodiment of a system according to the present invention.

An even more preferred embodiment of the present invention is shown in the form of system 80 in FIG. 5. The treatment system 80 receives spent abrasive slurry via a line 82 from a cutting device.

The spent abrasive slurry received from line 82 is first of all passed through a mixer unit 84 and then proceeds via line 86 to a first sedimentation unit in the form of a centrifuge 88. The solids depleted slurry is withdrawn from centrifuge 88 as an overflow via line 90 whereas a solids-concentrate is withdrawn as sludge from centrifuge 88 via line 92. As discussed in connection with the afore-described systems already, the quality of the solids-concentrate is such that it may be used without any further treatment as additive to lubricating fluid for producing fresh abrasive slurry.

The solids depleted slurry is directed via line 90 into a second sedimentation unit 94 which provides via line 96 a solids and partly fines depleted slurry whereas a fines concentrate comprising a substantial portion of fines is withdrawn from centrifuge 94 via line 98. The fines concentrate is usually discarded.

The solids and partly fines depleted slurry withdrawn via line 96 from the second sedimentation unit, i.e., centrifuge 94, is directed to a cross-flow separation unit 100. The cross-flow separation unit 100 yields a retentate which is withdrawn from the unit 100 via line 102 and discarded at least in part via line 103. Another portion of the retentate is recycled via line 105 to improve the separation efficiency of unit 100. The permeate in the form of a (solids and fines depleted) regenerated lubricant fluid is withdrawn via line 104.

As described already in connection with the system of FIG. 4, in the present, even more preferred embodiment of the inventive system also a part of the regenerated lubricant fluid is recycled via a line 106 and used to dilute the spent slurry received in the system via line 82. Here, line 106 communicates with the mixer unit 84, a static mixer which allows homogeneously distributing the spent abrasive slurry and the recycled portion of the regenerated lubricant fluid. The proportions of regenerated lubricant fluid and spent abrasive slurry admixed in mixer 84 correspond to the recommendations given already above in connection with the description of system 50 of FIG. 4.

In the presently described inventive system 80, optionally line 106 passes through a heating unit 108 which is used to heat the recycled regenerated lubricant fluid to a temperature of, e.g., 80° C. The heated fluid from heater 108 is fed into mixer 84 and provides for a substantial increase of the temperature of the admixed spent abrasive slurry and regenerated lubricant fluid which serves to decrease the viscosity of the fluid sent via line 86 to centrifuge 88. This improves the separation process in centrifuge 88 and provides for a better quality first solids concentrate which is withdrawn via line 92.

Also, the second sedimentation step performed in centrifuge 94 is improved by the increased temperature of the fluid received via line 90.

Still, the fluid sent via line 96 to the cross-flow separation unit 100 will be at an elevated temperature, such that the permeate (regenerated lubricant fluid) withdrawn from line 104 is at a temperature higher than ambient temperature.

Therefore, the portion of regenerated lubricant fluid passing through line 110 for re-use in a fresh abrasive slurry preferably is cooled down to about 20° C. via a cooler 112 prior to combining the same with the solids concentrate received from centrifuge 88 via line 92.

It is understood that the abrasive slurry needs to have a relatively high viscosity and therefore a low temperature, e.g., ambient temperature, in order to maintain abrasion efficiency of the slurry.

Figure 6:
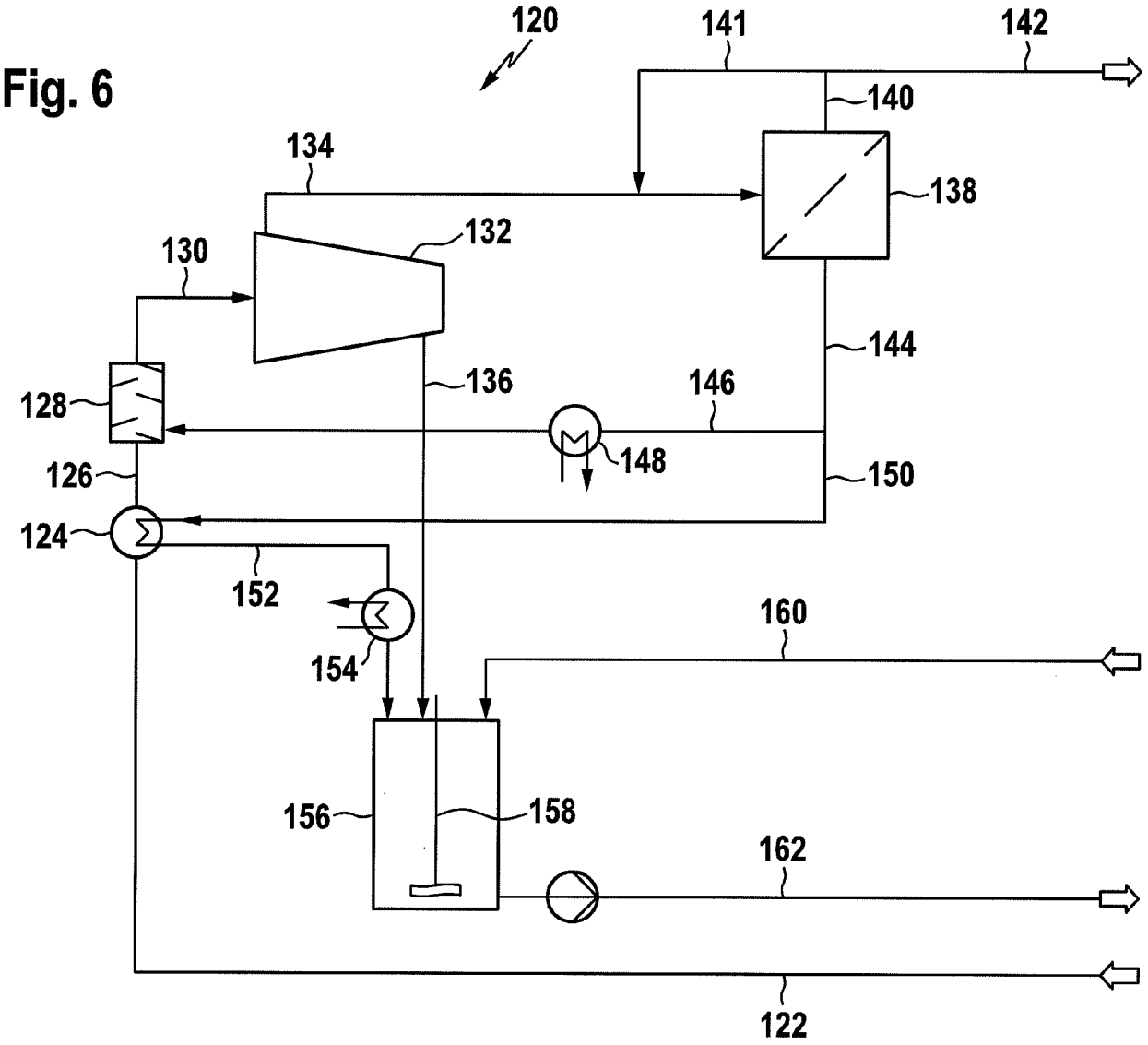
FIG. 6 shows another preferred embodiment of a system according to the preferred invention.

In the following example, the operation of a system 120 similar to the one explained in FIG. 5 will be explained in some more detail by way of FIG. 6.

The spent slurry received via line 122 contains two populations of solid particles. The coarser one consists of abrasive silicon carbide (e.g., SiC) particles ranging mainly from about 6 to about 50 μm in size with a pique at about 18 μm. The finer one is mainly a mixture of (SiC) fines and ground substrate material, e.g., silicon, mainly in the range from about 0.2 to about 5 μm in size with about 1 μm pique value.

The spent slurry flows into a heat exchanger 124 at ambient temperatures, e.g., at about 20° C. A fraction of regenerated lubricant fluid (e.g., PEG) enters the heat exchanger 124 at higher temperature, e.g., at about 60° C. A part of its enthalpy is transferred to the exhausted slurry, raising its temperature from about 20° C. to about 41° C. The regenerated PEG is simultaneously cooled down in heat exchanger 124 from about 60° C. to about 30° C.

The pre-heated spent slurry exits heat exchanger 124 via line 126 and is mixed and diluted with another fraction of the regenerated PEG in a static mixer 128. This fraction of regenerated PEG is preferably heated to a temperature of, e.g., about 80° C. which will allow to increase the temperature of the diluted spent slurry exiting the mixer 128 via line 130 to about 60° C. This mixture enters the centrifuge 132, e.g., a cylindrical-conical helical-conveyor solid bowl centrifuge. Here, the suspended solids and fines are classified into the two particle size fractions mentioned above. The coarser fraction of the grains (the "good grains") moves preferably to the inner wall of the rotating bowl. It is discharged as a solids concentrate or sludge from the centrifuge bowl at about 80° C. by means of the helical conveyor and is transferred via line 136 to a mixing tank 156. The finer fraction ("fines") preferably remains suspended in the solids depleted slurry and leaves the centrifuge 132 through a liquid overflow port and line 134.

The solids depleted slurry comprising the fines is conveyed via line 134 to a cross-flow membrane separation unit 138. The major volume of the slurry leaves this filtration unit 138 clarified as regenerated lubricant fluid. The fines are concentrated in a smaller volume of PEG (fines containing fraction).

One part of the fines containing fraction drained from filtration unit 138 via line 140 may be fed back into line 134 via line 141 and combined with the solids depleted slurry received from centrifuge 132. In order to obtain a thorough mixture of the one part of fines containing fraction drained from filtration unit 138 and the solids depleted slurry received from centrifuge 132 a holding tank (not shown) may be provided into which these fluids are fed. An outlet of the holding tank serves to feed the mixture to the filtration unit 138.

Another part of the fines containing fraction leaves the system via line 142 and is conventionally discarded.

The clarified regenerated lubricant fluid exits the filtration unit 138 as permeate via line 144 and is split into two fractions. One fraction is transferred via line 146 and heated up to about 80° C. by means of the heat exchanger 148 as mentioned before and is mixed with the spent slurry in the static mixer 128 in order to dilute the spent slurry and to heat it up to about 60° C. before flowing into the centrifuge 132.

The other fraction of the regenerated lubricant fluid first flows via line 150 to the heat exchanger 124 where it is cooled down to about 30° C., heating up the spent slurry from ambient temperature to about 41° C. From heat exchanger 124 the cooled-down regenerated lubricant fluid is withdrawn via line 152 and fed into a second heat exchanger 154 where it is further cooled down to about 9° C. in order to obtain ambient temperature of the mixture prepared in the mixing tank 156. Here an agitator 158 mixes the regenerated lubricant fluid with the sludge coming from the centrifuge 132 via line 136 and with some fresh PEG and with fresh abrasive particles received via line 160 in order to compensate the loss of materials due to the fines fraction discharged from the membrane filtration unit 138. The resulting mixture obtained in tank 156 is a regenerated abrasive slurry ready for re-use and sent back via line 162 to the cutting device. It is well understood that fresh PEG and fresh abrasive particles alternatively may be fed into mixing tank 156 via separate lines (not shown).

The invention claimed is:

1. A method for treating a spent abrasive slurry obtained from a process for cutting a body of a substrate material into wafer-like slices, said slurry comprising a lubricant fluid, unspent abrasive particles and fines, said method comprising separating the spent slurry in a first sedimentation step into a solids concentrate comprising unspent abrasive particles and a solids depleted slurry; and subsequently separating the solids depleted slurry by cross-flow filtration into a fines containing fraction and a solids and fines depleted regenerated lubricant fluid, wherein a portion of the regenerated lubricant fluid is passed through a heat exchanger to heat spent slurry, and wherein another portion of the regenerated lubricant fluid is recycled and admixed with spent slurry prior to subjecting the spent slurry to the first sedimentation step.

2. The method of claim 1, wherein said solids depleted slurry is subjected to a second sedimentation step to remove a fines concentrate comprising a proportion of fines prior to said cross-flow filtration and to provide a solids and partly fines depleted slurry.

3. The method of claim 1, wherein spent slurry admixed with said another portion of regenerated lubricant fluid is at a temperature selected in the range of from about 40° C. to about 60° C.

4. The method of claim 1, wherein a fraction of the portion of the regenerated lubricant fluid passed through the heat exchanger to heat spent slurry is recycled and admixed with spent slurry prior to subjecting the spent slurry to the first sedimentation step.

5. The method of claim 1, wherein the regenerated lubricant fluid and said abrasive spent slurry are admixed in a volume ratio of from about 0.5:1 to about 3:1.

6. The method of claim 5, wherein the regenerated lubricant fluid and the abrasive slurry are admixed in a volume ratio of from about 1:1 to about 3:1.

7. The method of claim 1, wherein the another portion of the regenerated lubricant fluid is heated prior to admixing the regenerated lubricant fluid with spent slurry.

8. The method of claim 7, wherein the regenerated lubricant fluid is heated to a temperature of about 35° C. or more.

9. The method of claim 1, further comprising admixing said solids concentrate and regenerated lubricant fluid to provide regenerated slurry.

10. The method of claim 9, wherein said regenerated slurry is admixed with fresh abrasive slurry.

11. The method of claim 9, wherein said regenerated lubricant fluid, said solids concentrate and fresh abrasive slurry are admixed to provide supplemented regenerated slurry.

* * * * *